US011126102B2

(12) United States Patent
Hashimoto et al.

(10) Patent No.: US 11,126,102 B2
(45) Date of Patent: Sep. 21, 2021

(54) TONER FOR DEVELOPING ELECTROSTATIC CHARGE IMAGE, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Yasuaki Hashimoto, Kanagawa (JP); Sakiko Takeuchi, Kanagawa (JP); Takashi Inukai, Kanagawa (JP); Daisuke Noguchi, Kanagawa (JP); Takuro Watanabe, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/918,367

(22) Filed: Jul. 1, 2020

(65) Prior Publication Data

US 2021/0240097 A1 Aug. 5, 2021

(30) Foreign Application Priority Data

Jan. 31, 2020 (JP) ..... JP2020-015620

(51) Int. Cl.

| | |
|---|---|
| ***G03G 9/08*** | (2006.01) |
| ***G03G 9/097*** | (2006.01) |
| ***G03G 15/08*** | (2006.01) |
| ***G03G 21/00*** | (2006.01) |
| ***G03G 21/18*** | (2006.01) |
| ***G03G 9/087*** | (2006.01) |
| ***G03G 9/113*** | (2006.01) |

(52) U.S. Cl.

CPC ..... *G03G 9/09725* (2013.01); *G03G 9/0819* (2013.01); *G03G 9/0821* (2013.01); *G03G 9/0827* (2013.01); *G03G 9/08768* (2013.01); *G03G 9/09708* (2013.01); *G03G 9/09716* (2013.01); *G03G 9/1138* (2013.01); *G03G 9/1139* (2013.01); *G03G 15/08* (2013.01); *G03G 21/0011* (2013.01); *G03G 21/18* (2013.01); *G03G 2215/00409* (2013.01)

(58) Field of Classification Search

CPC ..... G03G 9/09708; G03G 9/1138; G03G 9/1139; G03G 9/0819; G03G 9/0821

USPC ..... 430/108.1

See application file for complete search history.

(56) References Cited

FOREIGN PATENT DOCUMENTS

| | | |
|---|---|---|
| JP | 2006-317489 A | 11/2006 |
| JP | 2009-237274 A | 10/2009 |

*Primary Examiner* — Mark A Chapman

(74) *Attorney, Agent, or Firm* — Sughrue Mion, PLLC

(57) ABSTRACT

A toner for developing an electrostatic charge image contains toner particles, layered-compound particles, and inorganic particles. The percentage Fa of layered-compound particles free from the toner particles is 5% by volume or more and 20% by volume or less.

15 Claims, 2 Drawing Sheets

TONER FOR DEVELOPING ELECTROSTATIC CHARGE IMAGE, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2020-015620 filed Jan. 31, 2020.

BACKGROUND

(i) Technical Field

The present disclosure relates to a toner for developing an electrostatic charge image, an electrostatic charge image developer, a toner cartridge, a process cartridge, an image forming apparatus, and an image forming method.

(ii) Related Art

Japanese Unexamined Patent Application Publication No. 2006-317489 discloses a toner made with base toner and a melamine cyanurate powder. The base toner has an average roundness of 0.94 to 0.995 and a volume-average particle diameter of 3 μm to 9 μm. The melamine cyanurate powder has a volume-average particle diameter of 3 μm to 9 μm, and its amount is between 0.1 and 2.0 parts by weight per 100 parts by weight of the base toner.

Japanese Unexamined Patent Application Publication No. 2009-237274 discloses a positively charged toner made with colored resin particles and melamine cyanurate particles. The colored resin particles contain a binder resin, a coloring agent, and a positive-charge control agent. The melamine cyanurate particles have a number-average diameter (primary particles) of 0.05 μm to 1.5 μm, and their amount is between 0.01 and 0.5 parts by weight per 100 parts by weight of the colored resin particles.

SUMMARY

Aspects of non-limiting embodiments of the present disclosure relate to a toner for developing an electrostatic charge image. The toner contains toner particles, layered-compound particles, and inorganic particles. With toners for developing electrostatic charge images in which a percentage Fa of layered-compound particles free from toner particles is less than 5% by volume or more than 20% by volume, repeated formation of an image of low area coverage under hot and humid conditions (temperature of 30° C. and relative humidity of 85%) has resulted in color streaks associated with the wearing of the cleaning blade for the image carrier of the image forming apparatus used, and that under cold and dry conditions (10° C. and 10%) has resulted in color streaks associated with improper cleaning of the intermediate transfer body of the image forming apparatus used. This toner reduces both types of color streaks.

Aspects of non-limiting embodiments of the present disclosure relate to a toner for developing an electrostatic charge image. The toner contains toner particles, layered-compound particles, and inorganic particles. With toners for developing electrostatic charge images made with layered-compound particles with a frequency distribution of particle size having no peak within the diameter range of 0.1 μm to 1.5 μm or within the diameter range of 3 μm to 80 μm, repeated formation of an image of low area coverage under hot and humid conditions (temperature of 30° C. and relative humidity of 85%) has resulted in color streaks associated with the wearing of the cleaning blade for the image carrier of the image forming apparatus used, and that under cold and dry conditions (10° C. and 10%) has resulted in color streaks associated with improper cleaning of the intermediate transfer body of the image forming apparatus used. This toner reduces both types of color streaks.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a toner for developing an electrostatic charge image. The toner contains toner particles, layered-compound particles, and inorganic particles, and the percentage Fa of layered-compound particles free from the toner particles is 5% by volume or more and 20% by volume or less.

BRIEF DESCRIPTION OF THE DRAWINGS

Exemplary embodiments of the present disclosure will be described in detail based on the following figures, wherein.

DETAILED DESCRIPTION

Figure 1:
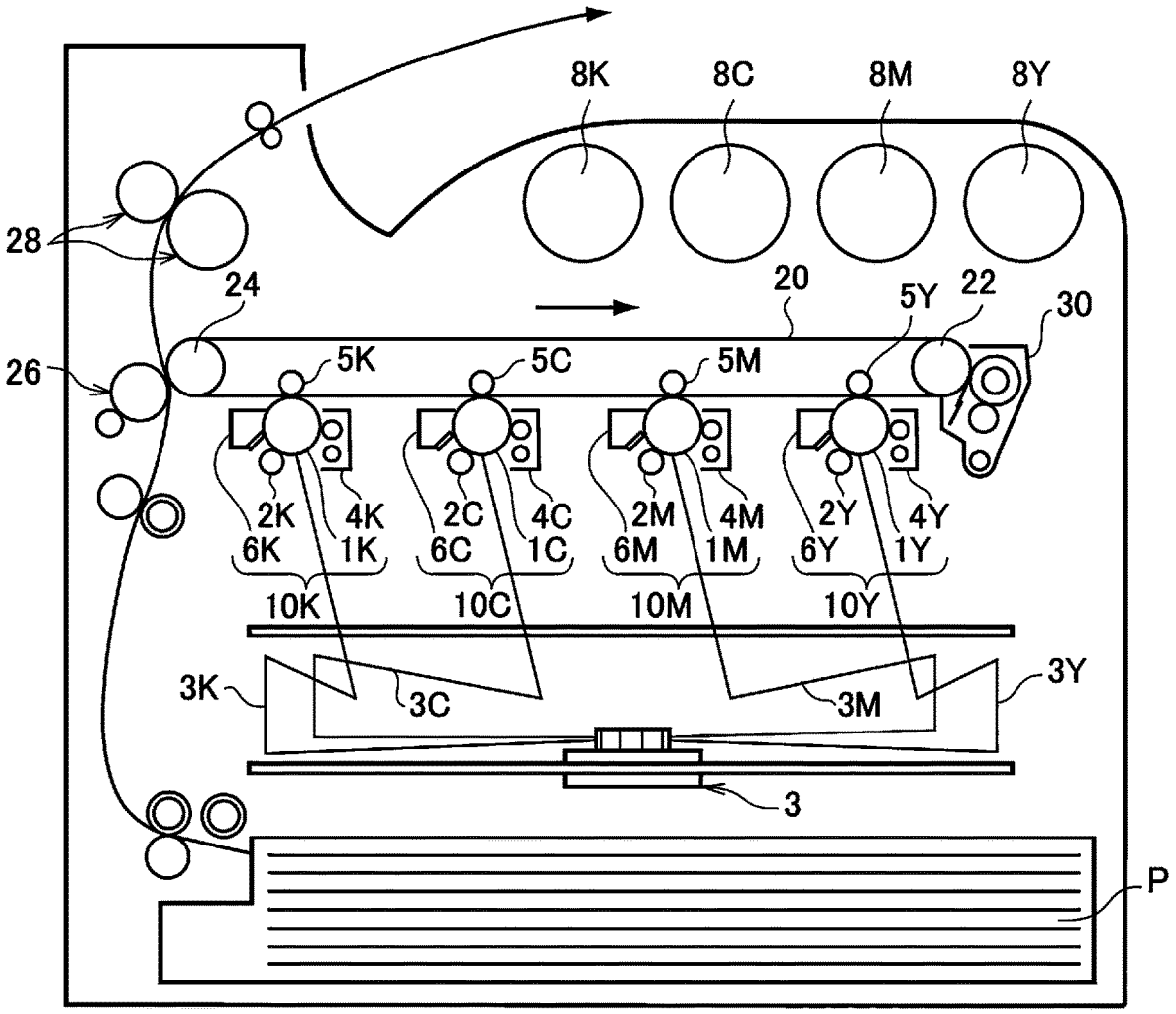
FIG. 1 schematically illustrates the structure of an example of an image forming apparatus according to an exemplary embodiment.

The following describes exemplary embodiments of the present disclosure. The following description and Examples are merely examples of the exemplary embodiments and do not limit the scope of the exemplary embodiments.

Numerical ranges specified with "A-B," "between A and B," "(from) A to B," etc., herein represent inclusive ranges, which include minimum A and maximum B as well as all values in between.

The present disclosure also mentions series of numerical ranges. The upper or lower limit of one of such numerical ranges may be substituted with the upper or lower limit of another numerical range in the same series. The upper or lower limit of a numerical range herein may be substituted with a value specified in Examples.

A gerund or action noun in the description of a certain process or method herein does not always represent an independent action. As long as its purpose is fulfilled, the action represented by the gerund or action noun may be continuous with or part of another.

A description of an exemplary embodiment herein may make reference to drawing(s). The reference, however, does not mean that what is illustrated is the only possible configuration of the exemplary embodiment. The size of elements in each drawing is conceptual; the relative sizes of the elements do not need to be as illustrated.

An ingredient herein may be a combination of multiple substances. If a composition described herein contains a combination of multiple substances as one of its ingredients, the amount of the ingredient represents the total amount of the substances in the composition unless stated otherwise.

An ingredient herein, furthermore, may be a combination of multiple kinds of particles. If a composition described herein contains a combination of multiple kinds of particles as one of its ingredients, the particle diameter of the ingredient is that of the mixture of the multiple kinds of particles present in the composition.

"A toner for developing an electrostatic charge image" herein may be simply referred to as "toner." "An electrostatic charge image developer" herein may be simply referred to as "a developer."

Toner for Developing an Electrostatic Charge Image

An exemplary embodiment of the present disclosure discloses a toner that contains toner particles, layered-compound particles, and inorganic particles. In this toner, the percentage Fa of layered-compound particles free from the toner particles is 5% by volume or more and 20% by volume or less. This toner is referred to as "the toner according to Exemplary Embodiment 1."

Another exemplary embodiment of the present disclosure also discloses a toner that contains toner particles, layered-compound particles, and inorganic particles. In this toner, the frequency distribution of particle size of the layered-compound particles has at least one peak within the diameter range of 0.1 μm to 1.5 μm and at least one peak within the diameter range of 3 μm to 80 μm. This toner is referred to as "the toner according to Exemplary Embodiment 2."

Some of the information given below is common to the toner according to Exemplary Embodiment 1 and the toner according to Exemplary Embodiment 2. In such a description, "toner according to an exemplary embodiment" is used as a generic term for the two types of toners.

In these exemplary embodiments, the percentage Fa of layered-compound particles free from the toner particles and the percentage Fb of inorganic particles free from the toner particles are determined by treating the toner with a surfactant and calculating the percentage areas of layered-compound particles and inorganic particles, respectively, before and after the treatment. Specifically, the following (1) to (3) are followed.

(1) The toner is imaged using a scanning electron microscope (SEM). The SEM image is loaded into an image analyzer (e.g., LUZEX AP, Nireco Corporation), and the total area A of layered-compound particles (or inorganic particles) and the total area B of toner particles in the image are determined. The fraction of total area A divided by total area B is converted into a percentage (%); this percentage is percentage area P (P=A/B×100). Percentage area P represents the total percentage area of the layered-compound particles (or inorganic particles) relative to the toner particles. The percentage area P of the layered-compound particles is denoted by Pa, and that of the inorganic particles is denoted by Pb.

(2) Two grams of the toner is added to 40 mL of a 0.2% by mass aqueous solution of Triton X-100 surfactant. Using a magnetic stirrer and a stirrer bar, the mixture is stirred at a rotation speed of 500 rpm for 30 seconds. The stirred mixture is transferred to a 50-mL centrifuge tube and centrifuged at a rotation speed of 10,000 rpm for 2 minutes, and the supernatant is removed. The precipitate is dispersed by adding 40 mL of deionized water, the resulting mixture is centrifuged at a rotation speed of 10,000 rpm for 2 minutes again, and the supernatant is removed. The precipitate is removed from the centrifuge tube and spread on a piece of filter paper. The spread layer is dried at room temperature (25° C.) for 20 hours to give a powder sample. The powder sample is imaged using an SEM, the SEM image is loaded into the image analyzer, and the total area A' of layered-compound particles (or inorganic particles) and the total area B' of toner particles in the image are determined. The fraction of total area A' divided by total area B' is converted into a percentage (%); this percentage is percentage area Q (Q=A'/B'×100). Percentage area Q represents the percentage area, relative to the toner particles, of layered-compound particles (or inorganic particles) not free from the toner particles. The percentage area Q of the layered-compound particles is denoted by Qa, and that of the inorganic particles is denoted by Qb.

(3) The percentage Fa is determined from percentage areas Pa and Qa, of the layered-compound particles, in accordance with the equation below. The percentage Fb is determined from percentage areas Pb and Qb, of the inorganic particles, in accordance with the equation below.

$$Fa=(Pa-Qa)/Pa\times 100$$

$$Fb=(Pb-Qb)/Pb\times 100$$

In (1) and (2), the number of particles observed is large enough that the determined percentage areas can be considered close to percentage volumes. At least 1000 particles are observed for each of total areas A, B, A', and B'. Multiple SEM images may be analyzed.

In these exemplary embodiments, the frequency distribution of particle size of the layered-compound particles is determined by the following measurement.

The toner is imaged using an SEM, and the SEM image is loaded into an image analyzer (e.g., LUZEX AP, Nireco Corporation). From the layered-compound particles present in the image, whether primary particles or aggregates, 1000 are selected randomly, and their respective equivalent circular diameters (nm) are calculated. For aggregates, one aggregate is counted as one layered-compound particle, and the equivalent circular diameter of each aggregate is calculated. The equivalent circular diameters of the 1000 particles are used to determine the particle size distribution on a frequency basis.

With the toner according to an exemplary embodiment, formation of an image of low area coverage under hot and humid conditions can be repeated with reduced occurrence of color streaks associated with the wearing of the cleaning blade for the image carrier of the image forming apparatus used. Formation of an image of low area coverage under cold and dry conditions, moreover, can be repeated with reduced occurrence of color streaks associated with improper cleaning of the intermediate transfer body of the image forming apparatus used. A possible mechanism is as follows.

In the related art, layered-compound particles (e.g., melamine cyanurate or boron nitride particles) have been added as an external additive to toners. The layered-compound particles, which are particles of a compound that has a layered structure with an interlayer distance on the order of Angstroms, are considered to provide lubrication through relative displacement between layers. In an image forming apparatus, the layered-compound particles as an external additive to the toner act as a lubricant at the point of contact between the image carrier and the cleaning blade for it and that between the intermediate transfer body and the cleaning blade for it.

Relatively non-hygroscopic, the layered-compound particles do not deteriorate easily, but rather often maintain their lubricating effect, even in image formation under hot and humid conditions (e.g., temperature of 30° C. and relative humidity of 85%) (i.e., even when voltage is applied to the layered-compound particles on the image carrier under hot and humid conditions). Repeated formation of an image of low area coverage under hot and humid conditions, however, can cause a stagnant supply of the layered-compound particles to the image carrier. The lubrication by the layered-compound particles can stop, resulting in color streaks (in the longitudinal direction) associated with the wearing of the cleaning blade for the image carrier.

If the percentage Fa of layered-compound particles free from toner particles in the toner is 5% by volume or more, however, the supply of layered-compound particles from the toner to the image carrier is smooth. This limits, the inventors believe, the wearing of the cleaning blade for the image carrier and, as a result, reduces color streaks associated with the wearing of the cleaning blade for the image carrier. In light of this, the percentage Fa may be 6% by volume or more, preferably 7% by volume or more.

The intermediate transfer body is supplied with layered-compound particles adhering to residual toner, or toner not transferred to the recording medium. An insufficient supply of layered-compound particles at this point can result in color streaks (in the transverse direction) associated with improper cleaning of the intermediate transfer body. This defect is common in repeated formation of an image of low area coverage under cold and dry conditions (e.g., temperature of 10° C. and relative humidity of 10%) (i.e., when layered-compound particles easily detach from the toner before reaching the intermediate transfer body while the supply of the toner to the intermediate transfer body is small).

If the percentage Fa of layered-compound particles free from toner particles in the toner is 20% by volume or less, the toner that reaches the intermediate transfer body contains sufficient layered-compound particles. The supply of layered-compound particles to the intermediate transfer body is therefore sufficient, and this reduces, the inventors believe, color streaks associated with improper cleaning of the intermediate transfer body. In light of this, the percentage Fa may be 15% by volume or less, preferably 10% by volume or less.

With the toner according to Exemplary Embodiment 2, it is easy to achieve a percentage Fa of 5% by volume or more and 20% by volume or less. In this toner, the frequency distribution of particle size of the layered-compound particles has at least one peak (first peak) within the diameter range of 0.1 μm to 1.5 μm and at least one peak (second peak) within the diameter range of 3 μm to 80 μm. The layered-compound particles that constitute the first peak are, the inventors believe, relatively unlikely to become released from the toner particles, whereas those that constitute the second peak are relatively easily do so.

The ratio by mass between the layered-compound particles constituting the first peak and those constituting the second (first/second) may be 1 or more and 10 or less, preferably 2 or more and 8 or less, more preferably 3 or more and 7 or less.

In the toner according to an exemplary embodiment, the percentage Fb of inorganic particles free from the toner particles may be 10% by volume or more and 30% by volume or less. This limits the adverse effect on the transfer of the toner image that occurs during prolonged and repeated image formation, particularly in repeated image formation on embossed paper under cold and dry conditions (e.g., temperature of 10° C. and relative humidity of 15%).

If the percentage Fb is 10% by volume or more and 30% by volume or less, the supply of inorganic particles to the intermediate transfer body is sufficient. The inorganic particles, the inventors believe, clean the surface of the intermediate transfer body effectively, preventing excessive coating of the surface with layered-compound particles.

The percentage Fb may be 10% by volume or more and 25% by volume or less, preferably 10% by volume or more and 20% by volume or less.

The ratio between the percentages Fa and Fb, Fa/Fb, may be 0.20 or more and 0.50 or less. This limits the adverse effect on the transfer of the toner image that occurs during prolonged and repeated image formation, particularly in repeated image formation on embossed paper under cold and dry conditions (e.g., temperature of 10° C. and relative humidity of 15%). Preferably, the ratio Fa/Fb is 0.20 or more and 0.40 or less, more preferably 0.20 or more and 0.35 or less.

The following describes the ingredients, structure, and characteristics of the toner according to an exemplary embodiment in detail.

Toner Particles

The toner particles contain, for example, a binder resin, optionally with a coloring agent, a release agent, and/or other additives.

Binder Resin

Examples of binder resins include vinyl resins that are homopolymers of monomers such as styrenes (e.g., styrene, para-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene) or copolymers of two or more such monomers.

Non-vinyl resins, such as epoxy resins, polyester resins, polyurethane resins, polyamide resins, cellulose resins, polyether resins, and modified rosin, mixtures of any such resin and vinyl resin(s), and graft copolymers obtained by polymerizing a vinyl monomer in the presence of any such non-vinyl resin may also be used.

One such binder resin may be used alone, or two or more may be used in combination.

Polyester resins may be used as binder resins.

Examples of polyester resins include known amorphous polyester resins. A combination of amorphous and crystalline polyester resins may also be used. In that case, the percentage of the crystalline polyester resin may be 2% by mass or more and 40% by mass or less (preferably 2% by mass or more and 20% by mass or less) of all binder resins.

It should be noted that if a resin is "crystalline" herein, it means that the endothermic profile of the resin as measured by differential scanning calorimetry (DSC) is not stepwise but has a clear peak, specifically a peak with a half width of 10° C. or narrower in DSC performed at a temperature elevation rate of 10 (° C./min).

The endothermic profile of an "amorphous" resin by DSC, by contrast, is stepwise or has no clear peak, or has a peak with a half width boarder than 10° C. under the same conditions.

Amorphous Polyester Resin

An example of an amorphous polyester resin is a polycondensate of a polycarboxylic acid and a polyhydric alcohol. An amorphous polyester resin may be a commercially available one or may be a synthesized one.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides or lower-alkyl (e.g., C1-5 alkyl) esters of such acids. Aromatic dicarboxylic acids, for example, are preferred.

A dicarboxylic acid may be used in combination with a crosslinked or branched carboxylic acid having three or more carboxylic groups. Examples of carboxylic acids having three or more carboxylic groups include trimellitic acid, pyromellitic acid, and anhydrides or lower-alkyl (e.g., C1-5 alkyl) esters of these acids.

One polycarboxylic acid may be used alone, or two or more may be used in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Aromatic diols and alicyclic diols, for example, are preferred, and aromatic diols are more preferred.

A diol may be used in combination with a crosslinked or branched polyhydric alcohol having three or more hydroxyl groups. Examples of polyhydric alcohols having three or more hydroxyl groups include glycerol, trimethylolpropane, and pentaerythritol.

One polyhydric alcohol may be used alone, or two or more may be used in combination.

The glass transition temperature (Tg) of the amorphous polyester resin may be 50° C. or more and 80° C. or less, preferably 50° C. or more and 65° C. or less.

This glass transition temperature is determined from the DSC curve of the resin, which is measured by differential scanning calorimetry (DSC), or more specifically is the "extrapolated initial temperature of glass transition" as in the methods for determining glass transition temperatures set forth in JIS K7121: 1987 "Testing Methods for Transition Temperatures of Plastics."

The weight-average molecular weight (Mw) of the amorphous polyester resin may be 5000 or more and 1000000 or less, preferably 7000 or more and 500000 or less.

The number-average molecular weight (Mn) of the amorphous polyester resin may be 2000 or more and 100000 or less.

The molecular weight distribution, Mw/Mn, of the amorphous polyester resin may be 1.5 or more and 100 or less, preferably 2 or more and 60 or less.

These weight- and number-average molecular weights are measured by gel permeation chromatography (GPC). The analyzer is Tosoh's HLC-8120 GPC chromatograph with Tosoh's TSKgel SuperHM-M column (15 cm), and the eluate is tetrahydrofuran (THF). Comparing the measurements with a molecular-weight calibration curve prepared using monodisperse polystyrene standards gives the weight- and number-average molecular weights.

The production of the amorphous polyester resin may be by a known method. A specific example is to polymerize raw materials at a temperature of 180° C. or more and 230° C. or less. The reaction system may optionally be evacuated to remove the water and alcohol that are produced as condensation proceeds.

If the raw-material monomers do not dissolve or are not miscible together at the reaction temperature, a solvent having a high boiling point may be added as a solubilizer to make the monomers dissolve. In that case, the solubilizer is removed by distillation during the polycondensation. Any monomer not miscible with the other(s) may be condensed with the planned counterpart acid(s) or alcohol(s) before the polycondensation process.

Crystalline Polyester Resin

An example of a crystalline polyester resin is a polycondensate of a polycarboxylic acid and a polyhydric alcohol. A crystalline polyester resin may be a commercially available one or may be a synthesized one.

The crystalline polyester resin may be a polycondensate made with linear aliphatic polymerizable monomers rather than aromatic ones. This helps the resin form its crystal structure.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), and anhydrides or lower-alkyl (e.g., C1-5 alkyl) esters of such acids.

A dicarboxylic acid may be used in combination with a crosslinked or branched carboxylic acid having three or more carboxylic groups. Examples of carboxylic acids having three or more carboxylic groups include aromatic carboxylic acids (e.g., 1,2,3-benzenetricarboxylic acid, 1,2,4-benzenetricarboxylic acid, and 1,2,4-naphthalenetricarboxylic acid) and anhydrides or lower-alkyl (e.g., C1-5 alkyl) esters of such acids.

A dicarboxylic acid such as listed above may be used in combination with a dicarboxylic acid having a sulfonic acid group and/or a dicarboxylic acid having an ethylenic double bond.

One polycarboxylic acid may be used alone, or two or more may be used in combination.

Examples of polyhydric alcohols include aliphatic diols (e.g., C7-20 linear aliphatic diols). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. 1,8-Octanediol, 1,9-nonanediol, and 1,10-decanediol are preferred.

A diol may be used in combination with a crosslinked or branched alcohol having three or more hydroxyl groups.

Examples of alcohols having three or more hydroxyl groups include glycerol, trimethylolethane, trimethylolpropane, and pentaerythritol.

One polyhydric alcohol may be used alone, or two or more may be used in combination.

The percentage of aliphatic diols in the polyhydric alcohol(s) may be 80 mol % or more, preferably 90 mol % or more.

The melting temperature of the crystalline polyester resin may be 50° C. or more and 100° C. or less, preferably 55° C. or more and 90° C. or less, more preferably 60° C. or more and 85° C. or less.

This melting temperature is the "peak melting temperature" of the resin as in the methods for determining melting temperatures set forth in JIS K7121: 1987 "Testing Methods for Transition Temperatures of Plastics" and is determined from the DSC curve of the resin, which is measured by differential scanning calorimetry (DSC).

The weight-average molecular weight (Mw) of the crystalline polyester resin may be 6,000 or more and 35,000 or less.

The production of the crystalline polyester resin may be by a known method. For example, the crystalline polyester resin may be produced in the same way as the amorphous polyester resin.

The binder resin content may be 40% by mass or more and 95% by mass or less, preferably 50% by mass or more and 90% by mass or less, more preferably 60% by mass or more and 85% by mass or less of the toner particles as a whole.

Coloring Agent

Examples of coloring agents include pigments, such as carbon black, chrome yellow, Hansa yellow, benzidine yellow, threne yellow, quinoline yellow, pigment yellow, permanent orange GTR, pyrazolone orange, Vulcan orange, Watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, Calco oil blue, methylene blue chloride, phthalocyanine blue, pigment blue, phthalocyanine green, and malachite green oxalate; and dyes, such as acridine, xanthene, azo, benzoquinone, azine, anthraquinone, thioindigo, dioxazine, thiazine, azomethine, indigo, phthalocyanine, aniline black, polymethine, triphenylmethane, diphenylmethane, and thiazole dyes.

One coloring agent may be used alone, or two or more may be used in combination.

The coloring agent(s) may optionally be surface-treated, or may be used in combination with a dispersant. Multiple coloring agents may be used.

The coloring agent content may be 1% by mass or more and 30% by mass or less, preferably 3% by mass or more and 15% by mass or less, of the toner particles as a whole.

Release Agent

Examples of release agents include hydrocarbon waxes; natural waxes, such as carnauba wax, rice wax, and candelilla wax; synthesized or mineral/petroleum waxes, such as montan wax; and ester waxes, such as fatty acid esters and montanates. Other release agents may also be used.

The melting temperature of the release agent may be 50° C. or more and 110° C. or less, preferably 60° C. or more and 100° C. or less.

This melting temperature is the "peak melting temperature" of the release agent as in the methods for determining melting temperatures set forth in JIS K7121: 1987 "Testing Methods for Transition Temperatures of Plastics" and is determined from the DSC curve of the release agent, which is measured by differential scanning calorimetry (DSC).

The release agent content may be 1% by mass or more and 20% by mass or less, preferably 5% by mass or less and 15% by mass or less, of the toner particles as a whole.

Other Additives

Examples of other additives include known additives, such as magnetic substances, charge control agents, and inorganic powders. Such additives, if used, are contained in the toner particles as internal additives.

Characteristics and Other Details of the Toner Particles

The toner particles may be single-layer toner particles or may be so-called core-shell toner particles, i.e., toner particles formed by a core section (core particle) and a coating layer that covers the core section (shell layer).

Core-shell toner particles may be formed by, for example, a core section made with a binder resin and optionally additives, such as a coloring agent and/or a release agent, and a coating layer made with a binder resin.

The volume-average diameter (D50v) of the toner particles may be 2 μm or more and 10 μm or less, preferably 4 m or more and 8 μm or less.

The volume-average diameter (D50v) of the toner particles is measured using a Coulter Multisizer II (Beckman Coulter) and an ISOTON-II electrolyte (Beckman Coulter).

Specifically, 0.5 mg or more and 50 mg or less of the toner particles as a sample for measurement is added to 2 ml of a 5% by mass aqueous solution of a surfactant (e.g., a sodium alkylbenzene sulfonate) as a dispersant. The resulting dispersion is added to 100 ml or more and 150 ml or less of the electrolyte.

The electrolyte with the sample suspended therein is sonicated for 1 minute using a sonicator. Using Coulter Multisizer II with an aperture size of 100 μm, the size distribution of 50000 sampled particles between 2 μm and 60 μm (diameter) is measured. The particle size distribution by volume is plotted, starting from the smallest diameter. The particle diameter at which the cumulative volume is 50% is the volume-average diameter D50v.

The average roundness of the toner particles may be 0.94 or more and 1.00 or less, preferably 0.95 or more and 0.98 or less.

The average roundness of the toner particles is given by (circumference of the equivalent circle)/(circumference) [(circumference of circles having the same projected area as particle images)/(circumference of projected images of the particles)]. Specifically, it is a value measured as follows.

First, a portion of the toner particles of interest is collected by aspiration to form a flat stream. This flat stream is photographed with a flash to capture the figures of the particles in a still image. The images of 3500 sampled particles are analyzed using a flow particle-image analyzer (Sysmex FPIA-3000), and the average roundness is determined from the results.

If the toner contains external additives, the external additives are removed beforehand by dispersing the toner (developer) in water containing a surfactant and sonicating the resulting dispersion.

Layered-Compound Particles

The layered-compound particles are particles of a compound that has a layered structure. Examples of layered-compound particles include melamine cyanurate particles, boron nitride particles, fluorinated graphite particles, molybdenum disulfide particles, and mica particles.

The frequency distribution of particle size of the layered-compound particles may have at least one peak within the diameter range of 0.1 μm to 1.5 μm (first range) and at least one peak within the diameter range of 3 μm to 80 μm (second range). This helps ensure that the percentage Fa is 5% by volume or more and 20% by volume or less.

The first range may be from 0.2 μm to 1.2 μm, preferably from 0.3 μm to 1.0 μm.

The second range may be from 8 μm to 50 μm, preferably from 10 μm to 35 μm.

A possible way to control the frequency distribution of particle size of the layered-compound particles is to use a combination of two or more kinds of layered-compound particles with different diameters. Possible ways to control the diameter of layered-compound particles include milling, classification, and a combination of milling and classification.

The number-average diameter (particle diameter in the frequency distribution of particle size at which the cumulative number of particles from the smallest diameter is 50%) of the layered-compound particles may be 0.2 μm or more and 5.0 μm or less, preferably 0.3 μm or more and 3.0 μm or less, more preferably 0.3 μm or more and 2.0 μm or less.

The layered-compound particle content may be 0.02% by mass or more, preferably 0.03% by mass or more, more preferably 0.05% by mass or more of the toner as a whole. This helps ensure the layered-compound particles have their intended lubricating effect. The layered-compound particle content may be 0.50% by mass or less, preferably 0.30% by mass or less, more preferably 0.20% by mass or less of the toner as a whole. This helps prevent excessive aggregation of the layered-compound particles.

Inorganic Particles Examples of inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The inorganic particles may have a hydrophobic surface created by hydrophobization. Examples of hydrophobizing agents include known organic silicon compounds having an alkyl group (e.g., the methyl, ethyl, propyl, or butyl group), specifically alkoxysilane compounds, siloxane compounds, and silazane compounds. Of these, silazane compounds are preferred, and hexamethyldisilazane is more preferred. One hydrophobizing agent may be used alone, or two or more may be used in combination.

As for how to make inorganic particles hydrophobic with a hydrophobizing agent, examples include the use of supercritical carbon dioxide, in which the hydrophobizing agent is attached to the surface of the inorganic particles by dissolving the hydrophobizing agent in supercritical carbon dioxide; preparing a solution of the hydrophobizing agent in a solvent and attaching the solution (e.g., by spraying or application) to the surface of the inorganic particles in the air; and preparing a solution of the hydrophobizing agent in a solvent, adding the solution to a liquid dispersion of the inorganic particles, and then, after a while, drying the mixture of a liquid dispersion of the inorganic particles and the solution, all in the air.

The number-average diameter of the inorganic particles (e.g., silica particles) may be 40 nm or more and 200 nm or less, preferably 50 nm or more and 180 nm or less, more preferably 60 nm or more and 160 nm or less. This helps ensure that the percentage Fb is 10% by volume or more and 30% by volume or less.

The frequency distribution of particle size of the inorganic particles (e.g., silica particles) may have at least one peak within the diameter range of 40 nm to 80 nm (first range) and at least one peak within the diameter range of 80 nm to 200 nm (second range). This helps ensure that the percentage Fb is 10% by volume or more and 30% by volume or less.

The first range may be from 40 nm to 70 nm, preferably from 40 nm to 60 nm.

The second range may be from 90 nm to 180 nm, preferably from 100 nm to 160 nm.

The number-average diameter of the inorganic particles is determined as follows.

First, the inorganic particles are isolated from the toner. The isolation of the inorganic particles from the toner may be by any method. For example, the toner is dispersed in water containing a surfactant, and the resulting liquid dispersion is sonicated. The sonicated dispersion is centrifuged at a high speed to separate the toner particles, the inorganic particles, and any other external additives by specific gravity. The fraction containing the inorganic particles is collected. Drying the collected fraction gives the inorganic particles.

Then the inorganic particles are added to an aqueous solution of an electrolyte, and the resulting mixture is sonicated for 30 seconds or longer to disperse the particles. The diameter of at least 3000 inorganic particles in the resulting liquid dispersion is measured using a laser diffraction particle size distribution analyzer (e.g., Microtrac MT3000 II, MicrotracBEL), and the particle size distribution on a frequency basis is determined from the results. The particle diameter at which the cumulative number of particles from the smallest diameter is 50% is the number-average diameter of the inorganic particles.

The inorganic particle (e.g., silica particle) content may be 1.0% by mass or more and 7.0% by mass or less, preferably 1.5% by mass or more and 6.0% by mass or less, more preferably 2.0% by mass or more and 5.5% by mass or less of the toner as a whole. This helps ensure that the percentage Fb is 10% by volume or more and 30% by volume or less.

In the toner according to an exemplary embodiment, the ratio by mass between the layered-compound particle content and the inorganic particle (e.g., silica particle) content (layered-compound particles/inorganic particles) may be 0.01 or more and 0.50 or less, preferably 0.015 or more and 0.30 or less, more preferably 0.02 or more and 0.10 or less. This helps control the ratio Fa/Fb.

Other External Additives

The toner according to an exemplary embodiment may contain extra external additives in addition to the layered-compound particles and the inorganic particles. Examples of extra external additives include resin particles (particles of polystyrene, polymethyl methacrylate, melamine resins, etc.) and active cleaning agents (e.g., metal salts of higher fatty acids, typically zinc stearate, and particles of fluoropolymers).

In the toner according to an exemplary embodiment, the total percentage of external additives other than the layered-compound particles and the inorganic particles, if contained, may be 0.01% by mass or more and 5.0% by mass or less, preferably 0.01% by mass or less and 2.0% by mass or less, of the toner particles.

Production of the Toner

The toner according to an exemplary embodiment is obtained by producing the toner particles and then adding the external additives to the toner particles.

The production of the toner particles may be by a dry process (e.g., kneading and milling) or wet process (e.g., aggregation and coalescence, suspension polymerization, or dissolution and suspension). Any known dry or wet process may be used. Preferably, the toner particles are obtained by aggregation and coalescence.

Specifically, if the toner particles are produced by, for example, aggregation and coalescence, the process includes preparing a liquid dispersion of the resin particles that will serve as a binder resin (preparation of a liquid dispersion of resin particles), allowing the resin particles (and optionally other kind(s) of particles) to form aggregates in the liquid dispersion (or a liquid dispersion prepared by mixing with other liquid dispersion(s) of particles) (formation of aggregates), and heating the resulting liquid dispersion of aggregates to make the aggregates fuse and coalesce together, thereby forming toner particles (fusion and coalescence).

In the following, this process is described in detail.

It should be noted that the method described below gives toner particles that contain a coloring agent and a release agent, but the coloring agent and the release agent are optional. Naturally, additives other than a coloring agent and a release agent may also be used.

Preparation of a Liquid Dispersion of Resin Particles

First, a liquid dispersion of the resin particles that will serve as a binder resin is prepared. A liquid dispersion of coloring-agent particles and a liquid dispersion of release-agent particles, for example, are also prepared.

The preparation of the liquid dispersion of resin particles is by, for example, dispersing the resin particles in a dispersion medium using a surfactant.

An example of a dispersion medium for the liquid dispersion of resin particles is an aqueous medium.

Examples of aqueous media include types of water, such as distilled water and deionized water, and alcohols. One such dispersion medium may be used alone, or two or more may be used in combination.

Examples of surfactants include anionic surfactants, such as sulfates, sulfonates, phosphates, and soap surfactants; cationic surfactants, such as amine salts and quaternary ammonium salts; and nonionic surfactants, such as polyethylene glycol surfactants, ethylene oxide adducts of alkylphenols, and polyhydric alcohols. Anionic surfactants and cationic surfactants are preferred. Nonionic surfactants may be used in combination with an anionic or cationic surfactant.

One surfactant may be used alone, or two or more may be used in combination.

In the preparation of the liquid dispersion of resin particles, the resin particles may be dispersed in the dispersion medium by a commonly used dispersion technique, such as a rotary-shear homogenizer or a medium mill, e.g., a ball mill, sand mill, or Dyno-Mill. For certain types of resin particles, phase inversion emulsification may be used. Phase inversion emulsification is a technique in which the resin to be dispersed is dissolved in a hydrophobic organic solvent in which the resin is soluble, the resulting organic continuous phase (O phase) is neutralized with a base, and then an aqueous medium (W phase) is added to invert the phases from W/O to O/W, thereby dispersing particles of the resin in the aqueous medium.

The volume-average diameter of the resin particles to be dispersed in the liquid dispersion may be, for example, 0.01 μm or more and 1 μm or less, preferably 0.08 μm or more and 0.8 μm or less, more preferably 0.1 μm or more and 0.6 μm or less.

The volume-average diameter of the resin particles is measured as follows. That is, the size distribution of the particles is measured using a laser-diffraction particle size distribution analyzer (e.g., HORIBA LA-700). The measured distribution is divided into segments by particle size (channels), and the cumulative distribution of volume is plotted starting from the smallest diameter. The particle diameter at which the cumulative volume is 50% of the total volume of the particles is the volume-average diameter D50v of the particles. For the other liquid dispersions, too, the measurement of the volume-average diameter of particles therein is the same.

The resin particle content of the liquid dispersion of resin particles may be 5% by mass or more and 50% by mass or less, preferably 10% by mass or more and 40% by mass or less.

The liquid dispersion of coloring-agent particles and that of release-agent particles, for example, are also prepared in the same way as the liquid dispersion of resin particles. The above description about the volume-average diameter of particles, dispersion medium, how to disperse the particles, and the particle content for the liquid dispersion of resin particles therefore also applies to the coloring-agent particles and the release-agent particles in their respective liquid dispersions.

Formation of Aggregates

Then, the liquid dispersion of resin particles is mixed with the liquid dispersion of coloring-agent particles and the liquid dispersion of release-agent particles.

In the mixture of liquid dispersions, the resin particles, the coloring-agent particles, and the release-agent particles are allowed to aggregate together. This process of heteroaggregation is continued until aggregates of the resin particles, the coloring-agent particles, and the release-agent particles grow to a diameter close to the planned diameter of the toner particles.

Specifically, for example, a flocculant is added to the mixture of liquid dispersions. The pH of the mixture is adjusted to an acidic level (e.g., a pH of 2 or more and 5 or less), optionally followed by the addition of a dispersion stabilizer. The mixture of liquid dispersions is then heated to a temperature close to the glass transition temperature of the resin particles (specifically, for example, a temperature higher than or equal to the glass transition temperature the resin particles—30° C. but not higher than the glass transition temperature of the resin particles—10° C.). This makes the particles dispersed in the mixture form aggregates.

In the formation of aggregates, for example, the mixture of liquid dispersions may be stirred using a rotary-shear homogenizer, and the flocculant may be added at room temperature (e.g., 25° C.) with the mixture stirred. Then the pH of the mixture is adjusted to an acidic level (e.g., a pH of 2 or more and 5 or less), optionally followed by the addition of a dispersion stabilizer, and the mixture is heated as described above.

Examples of flocculants include surfactants that have the opposite polarity to the surfactant(s) contained in the mixture of liquid dispersions, inorganic metal salts, and metal complexes having a valency of 2 or more. The use of a metal complex as a flocculant improves charging characteristics because less surfactant is used in that case.

Optionally, an additive that forms a complex or similar bond with metal ions from the flocculant may be used. An example is a chelating agent.

Examples of inorganic metal salts include metal salts, such as calcium chloride, calcium nitrate, barium chloride, magnesium chloride, zinc chloride, aluminum chloride, and aluminum sulfate; and polymers of inorganic metal salts, such as polyaluminum chloride, polyaluminum hydroxide, and calcium polysulfide.

The chelating agent may be a water-soluble one. Examples of chelating agents include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of chelating agent added may be 0.01 parts by mass or more and 5.0 parts by mass or less, preferably 0.1 parts by mass or more and less than 3.0 parts by mass, per 100 parts by mass of the resin particles.

Fusion and Coalescence

Then, the aggregates are caused to fuse and coalesce together to form toner particles, for example by heating the liquid dispersion of aggregates to a temperature equal to or higher than the glass transition temperature of the resin particles (e.g., 10° C. to 30° C. higher than the glass transition temperature of the resin particles).

In this way, the toner particles are obtained.

Alternatively, the liquid dispersion of aggregates prepared may be mixed with another volume of the liquid dispersion of resin particles. The aggregates and the resin particles are caused to aggregate together in such a manner that additional resin particles will adhere to the surface of the aggregates, forming a second form of aggregates. The liquid dispersion of the second form of aggregates is heated to make the second form of aggregates fuse and coalesce together to form core/shell toner particles.

After the end of fusion and coalescence, the toner particles, formed in a solution, are washed, separated from the solution, and dried by known methods to give dry toner particles. The washing may be by sufficient replacement with deionized water in view of chargeability. The separation from the solution may be by suction filtration, pressure filtration, etc., in view of productivity. The drying may be by lyophilization, flash drying, fluidized drying, vibrating fluidized drying, etc., in view of productivity.

The toner according to an exemplary embodiment is then produced, for example by adding the external additives to the dry toner particles and mixing them. The mixing may be through the use of, for example, a V-blender, Henschel mixer, or Ladige mixer. Optionally, coarse particles may be removed from the toner, for example using a vibrating sieve or air-jet sieve.

The external additives may be added to the toner particles in divided portions (e.g., two divided portions) to control the percentages Fa and Fb. External additives added earlier tend to adhere more firmly to the toner particles and therefore less easily become released from the toner particles.

Electrostatic Charge Image Developer

An electrostatic charge image developer according to an exemplary embodiment contains at least a toner according to the above exemplary embodiment.

The electrostatic charge image developer according to this exemplary embodiment may be a one-component developer, which is substantially the toner according to an exemplary embodiment, or may be a two-component developer, which is a mixture of the toner and a carrier.

The carrier may be any known type of carrier. Examples include coated carriers, which are made by coating the surface of a magnetic powder as a core material with resin; magnetic powder-dispersed carriers, which are made by dispersing and mixing a magnetic powder in a matrix resin; and resin-impregnated carriers, which are made by impregnating a porous magnetic powder with resin. Magnetic powder-dispersed or resin-impregnated carriers having a resin coating on the surface of the particles forming the powder may also be used.

Examples of magnetic powders include powders of magnetic metals, such as iron, nickel, and cobalt; and powders of magnetic oxides, such as ferrite and magnetite.

Examples of resins, for use as a coating or matrix, include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins, which have organosiloxane bonds, or their modified forms, fluoropolymers, polyester, polycarbonate, phenolic resins, and epoxy resins. Resins containing additives, such as electrically conductive particles, may also be used. Examples of electrically conductive particles include particles of gold, silver, copper, and other metals, carbon black, titanium oxide, zinc oxide, tin oxide, barium sulfate, aluminum borate, and potassium titanate.

The coating of the surface of the core material with resin may be, for example, through the use of a solution of the coating resin and additives (optional) in a solvent. The solvent may be of any kind and is selected considering, for example, the coating resin used and suitability for coating.

Specific examples of how to coat the surface of the core material with resin include dipping, in which the core material is immersed in the solution of the coating resin; spraying, in which the solution of the coating resin is sprayed onto the surface of the core material; fluidized bed coating, in which the solution of the coating resin is sprayed onto a core material floated on a stream of air; and kneader-coater coating, in which the core material for the carrier and the solution of the coating resin are mixed in a kneader-coater, and then the solvent is removed.

For a two-component developer, the ratio (by mass) in which the toner and the carrier are mixed may be between 1:100 (toner:carrier) and 30:100, preferably between 3:100 and 20:100.

Image Forming Apparatus and Image Forming Method

An image forming apparatus according to an exemplary embodiment includes an image carrier; a charging component that charges the surface of the image carrier; an electrostatic charge image creating component that creates an electrostatic charge image on the charged surface of the image carrier; a developing component that contains an electrostatic charge image developer and develops, using the electrostatic charge image developer, the electrostatic charge image created on the surface of the image carrier to form a toner image; an intermediate transfer body to which the toner image is transferred from the surface of the image carrier; a first transfer component that transfers the toner image on the surface of the image carrier to the surface of the intermediate transfer body; a second transfer component that transfers the toner image on the surface of the intermediate transfer body to a recording medium; a fixing component that fixes the toner image on the surface of the recording medium; a cleaning component for the image carrier that has a blade touching the surface of the image carrier and cleans, using the blade, residual toner off the surface of the image carrier from which the toner image has been transferred; and a cleaning component for the intermediate transfer body that has a blade touching the surface of the intermediate transfer body and cleans, using the blade, residual toner off the surface of the intermediate transfer body from which the toner image has been transferred to the surface of the recording medium. The electrostatic charge image developer is an electrostatic charge developer according to the above exemplary embodiment.

The image forming apparatus according to this exemplary embodiment performs an image forming method (image forming method according to an exemplary embodiment) that includes charging the surface of an image carrier; creating an electrostatic charge image on the charged surface of the image carrier; developing, using an electrostatic charge image developer according to the above exemplary embodiment, the electrostatic charge image created on the surface of the image carrier to form a toner image; transferring the toner image on the surface of the image carrier to the surface of an intermediate transfer body (first transfer); transferring the toner image on the surface of the intermediate transfer body to the surface of a recording medium (second transfer); fixing the toner image on the surface of the recording medium; cleaning, by putting a blade on the surface of the image carrier, residual toner off the surface of the image carrier from which the toner image has been transferred; and cleaning, by putting a blade on the surface of the intermediate transfer body, residual toner off the surface of the intermediate transfer body from which the toner image has been transferred to the surface of the recording medium.

The configuration of the image forming apparatus according to this exemplary embodiment is applied to known types of image forming apparatuses. An example is apparatuses that have a static eliminator, which removes static electricity from the surface of the image carrier by irradiating the surface with antistatic light between the transfer of the toner image and charging.

Part of the image forming apparatus according to this exemplary embodiment, e.g., a portion including the developing component, may have a cartridge structure, i.e., a structure that allows the part to be attached to and detached from the image forming apparatus (or may be a process cartridge). An example of a process cartridge is one that contains the electrostatic charge image developer according to the above exemplary embodiment and includes the developing component.

The following describes an example of an image forming apparatus according to this exemplary embodiment. It should be noted that the image forming apparatus according to this exemplary embodiment is not limited to this example. The following description is focused on structural elements illustrated in a drawing.

FIG. 1 schematically illustrates the structure of an image forming apparatus according to this exemplary embodiment.

The image forming apparatus illustrated in FIG. 1 includes first to fourth electrophotographic image forming units 10Y, 10M, 10C, and 10K (image forming component) that produce images in the colors of yellow (Y), magenta (M), cyan (C), and black (K), respectively, based on color-separated image data. The image forming units (hereinafter also referred to simply as "units") 10Y, 10M, 10C, and 10K are arranged in a horizontal row with a predetermined distance therebetween. The units 10Y, 10M, 10C, and 10K may be process cartridges, i.e., units that are attached to and detached from the image forming apparatus.

Above the units 10Y, 10M, 10C, and 10K is an intermediate transfer belt (example of an intermediate transfer body) 20, which also extends through each of the units. The intermediate transfer belt 20 is wound over a drive roller 22 and a support roller 24 and runs in the direction from the first unit 10Y to the fourth unit 10K. A spring or similar mechanism, not illustrated, applies force to the support roller 24 in the direction away from the drive roller 22, placing tension on the intermediate transfer belt 20 wound over the two rollers. On the image carrier side of the intermediate transfer belt 20 is a cleaning device 30 for the intermediate transfer belt 20, facing the drive roller 22.

In an exemplary configuration, the intermediate transfer belt 20 is a laminate of a base layer and a surface layer on the outer surface of the base layer. The base layer in an exemplary configuration contains resin, such as a polyimide, polyamide, polyamideimide, polyether ester, polyarylate, or polyester resin, and an electrically conductive agent. The surface layer in an exemplary configuration contains at least one of resins such as listed above, a fluoropolymer, and an electrically conductive agent. The thickness of the intermediate transfer belt 20 is, for example, 50 μm or more and 100 μm or less.

The developing devices (example of a developing component) 4Y, 4M, 4C, and 4K of the units 10Y, 10M, 10C, and 10K are supplied with toners in yellow, magenta, cyan, and black, respectively, contained in toner cartridges 8Y, 8M, 8C, and 8K.

The first to fourth units 10Y, 10M, 10C, and 10K are equivalent in structure and operation. In the following, the first unit 10Y, which is located upstream of the others in the direction of running of the intermediate transfer belt 20 and forms a yellow image, is described to represent the four units.

The first unit 10Y has a photoreceptor 1Y that operates as an image carrier. Around the photoreceptor 1Y are a charging roller (example of a charging component) 2Y that charges the surface of the photoreceptor 1Y to a predetermined potential; an exposure device (example of an electrostatic charge image creating component) 3 that irradiates the charged surface with a laser beam 3Y based on a color-separated image signal to create an electrostatic charge image there; a developing device (example of a developing component) 4Y that supplies charged toner to the electrostatic charge image to develop the electrostatic charge image; a first transfer roller (example of a first transfer component) 5Y that transfers the developed toner image to the intermediate transfer belt 20; and a photoreceptor cleaning device (example of a cleaning component for the image carrier) 6Y that removes residual toner off the surface of the photoreceptor 1Y after the first transfer, arranged in this order.

The first transfer roller 5Y is inside the intermediate transfer belt 20 and faces the photoreceptor 1Y. The first transfer rollers 5Y, 5M, 5C, and 5K of the units are connected to bias power supplies (not illustrated), which apply a first transfer bias to the rollers. The bias power supplies change the value of the transfer bias they apply to the first transfer rollers under the control of a controller, not illustrated.

The photoreceptor cleaning device 6Y has a cleaning blade touching the surface of the photoreceptor 1Y. While the photoreceptor 1Y continues rotating even after the toner image is transferred therefrom to the intermediate transfer belt 20, the cleaning blade removes residual toner off the surface of the photoreceptor 1Y by touching there.

Downstream of the fourth unit 10K are a second transfer roller (example of a second transfer component) 26 and the support roller 24. The second transfer roller 26 is on the image-carrying side of the intermediate transfer belt 20, and the support roller 24 touches the inner surface of the intermediate transfer belt 20. The second transfer roller 26 and the support roller 24 form a second transfer section.

The cleaning device 30 for the intermediate transfer belt 20 has a cleaning blade touching the surface of the intermediate transfer belt 20. While the intermediate transfer belt 20 continues running even after the toner image is transferred therefrom to the recording medium, the cleaning blade removes residual toner off the surface of the intermediate transfer belt 20 by touching there. Examples of materials for the cleaning blades include thermosetting polyurethane rubbers, silicone rubber, fluorocarbon rubber, and ethylene-propylene-diene rubber.

The following describes how the first unit 10Y operates to form a yellow image.

First, the charging roller 2Y charges the surface of the photoreceptor 1Y to a potential of −600 V to −800 V beforehand.

The photoreceptor 1Y is a stack of an electrically conductive (e.g., a volume resistivity at 20° C. of $1\times10^{-6}$ Ωcm or less) substrate and a photosensitive layer thereon. The photosensitive layer is highly resistant (has the typical resistance of resin) in its normal state, but when it is irradiated with a laser beam, the resistivity of the irradiated portion changes. Thus, the charged surface of the photoreceptor 1Y is irradiated with a pattern of a laser beam 3Y that the exposure device 3 emits on the basis of data for the yellow image sent from a controller, not illustrated. This creates an electrostatic charge image as a pattern for the yellow image on the surface of the photoreceptor 1Y.

The electrostatic charge image is an image created on the surface of the photoreceptor 1Y as a result of charging. Once the laser beam 3Y reduces the resistivity of the irradiated portion of the photosensitive layer, the charge on the surface of the photoreceptor 1Y flows away. The charge on the portion not irradiated with the laser beam 3Y stays. The resulting electrostatic charge image is therefore a so-called negative latent image.

As the photoreceptor 1Y rotates, the electrostatic charge image created on the photoreceptor 1Y moves to a predetermined development point. At the development point, the developing device 4Y develops the electrostatic charge image on the photoreceptor 1Y into a visible toner image.

Inside the developing device 4Y is an electrostatic charge image developer that contains, for example, at least yellow toner and a carrier. The yellow toner is on a developer roller (example of a developer carrier) and has been triboelectrically charged with the same polarity as the charge on the photoreceptor 1Y (negative) as a result of stirring inside the developing device 4Y. The surface of the photoreceptor 1Y passes through this developing device 4Y, during which the yellow toner electrostatically adheres to the uncharged, latent image portion of the surface of the photoreceptor 1Y, thereby developing the latent image. Then the photoreceptor 1Y, with a yellow toner image thereon, continues running at a predetermined speed to transport the developed toner image thereon to a predetermined first transfer point.

After the arrival of the yellow toner image on the photoreceptor 1Y at the first transfer point, a first transfer bias is applied to the first transfer roller 5Y. Electrostatic force directed from the photoreceptor 1Y to the first transfer roller 5Y acts on the toner image on the photoreceptor 1Y to transfer it to the intermediate transfer belt 20. The applied transfer bias has the (+) polarity, opposite the polarity of the toner (−), and its amount is controlled by a controller (not illustrated) to, for example, +10 μA for the first unit 10Y.

After the transfer of the toner image therefrom to the intermediate transfer belt 20, the photoreceptor 1Y continues rotating and comes into contact with the cleaning blade of the photoreceptor cleaning device 6Y. Residual toner on the photoreceptor 1Y is removed and collected at the photoreceptor cleaning device 6Y.

The first transfer biases applied to the first transfer rollers 5M, 5C, and 5K of the second, third, and fourth units 10M, 10C, and 10K are also controlled in the same way as that to the first unit 10Y.

The intermediate transfer belt 20 to which a yellow toner image has been transferred at the first unit 10Y in this way is then moved to pass through the second to fourth units 10M, 10C, and 10K sequentially. Toner images in the respective colors are overlaid, completing multilayer transfer.

After this multilayer transfer of toner images in four colors by passing through the first to fourth units, the intermediate transfer belt 20 reaches the second transfer section, formed by the intermediate transfer belt 20, the support roller 24 touching the inner surface of the intermediate transfer belt 20, and the second transfer roller (example of a second transfer component) 26 on the image-carrying side of the intermediate transfer belt 20. Recording paper (example of a recording medium) P is delivered to the point of contact between the second transfer roller 26 and the intermediate transfer belt 20 in a timed manner by a feeding mechanism, and a second transfer bias is applied to the support roller 24. The applied transfer bias has the (−) polarity, the same as the polarity of the toner (−). Electrostatic force directed from the intermediate transfer belt 20 to the recording paper P acts on the toner image on the intermediate transfer belt 20 to transfer it to the recording paper P. The amount of the second transfer bias is controlled; it is determined in accordance with the resistance detected by a resistance detector (not illustrated) that detects the resistance of the second transfer section.

The intermediate transfer belt 20 from which the toner image has been transferred to the recording paper P continues running and comes into contact with the cleaning blade of the cleaning device 30 for the intermediate transfer belt 20. Residual toner on the intermediate transfer belt 20 is removed and collected at the cleaning device 30 for the intermediate transfer belt 20.

The recording paper P with the transferred toner image thereon is sent to the point of pressure contact (nip) between a pair of fixing rollers at a fixing device (example of a fixing component) 28. The toner image is fixed on the recording paper P, producing a fixed image.

Examples of types of recording paper P to which the toner image is transferred include ordinary printing paper for copiers, printers, etc., of electrophotographic type. In addition to recording paper P, overhead-projector (OHP) film is also an example of a recording medium.

For improved smoothness of the surface of the fixed image, the recording paper P may have a smooth surface. For example, coated paper, which is paper having a coated surface, for example a resin-coated surface, or art paper for printing purposes may be used.

After the completion of the fixation of the color image, the recording paper P is transported to an ejection section to finish the formation of a color image.

Process Cartridge and Toner Cartridge A process cartridge according to an exemplary embodiment includes an image carrier; a developing component that contains an electrostatic charge image developer according to an above exemplary embodiment and develops, using the electrostatic charge image developer, an electrostatic charge image created on the surface of the image carrier to form a toner image; an intermediate transfer body to which the toner image is transferred from the surface of the image carrier; a cleaning component for the image carrier that has a blade touching the surface of the image carrier and cleans, using the blade, residual toner off the surface of the image carrier from which the toner image has been transferred; and a cleaning component for the intermediate transfer body that has a blade touching the surface of the intermediate transfer body and cleans, using the blade, residual toner off the surface of the intermediate transfer body from which the toner image has been transferred to the surface of a recording medium. The process cartridge is attached to and detached from an image forming apparatus.

The process cartridge according to this exemplary embodiment is not limited to this configuration. For example, it may further have at least one selected from components like a charging component and an electrostatic charge image creating component.

The following describes an example of a process cartridge according to this exemplary embodiment. It should be noted that the process cartridge according to this exemplary embodiment is not limited to this example. The following description is focused on structural elements illustrated in a drawing.

Figure 2:
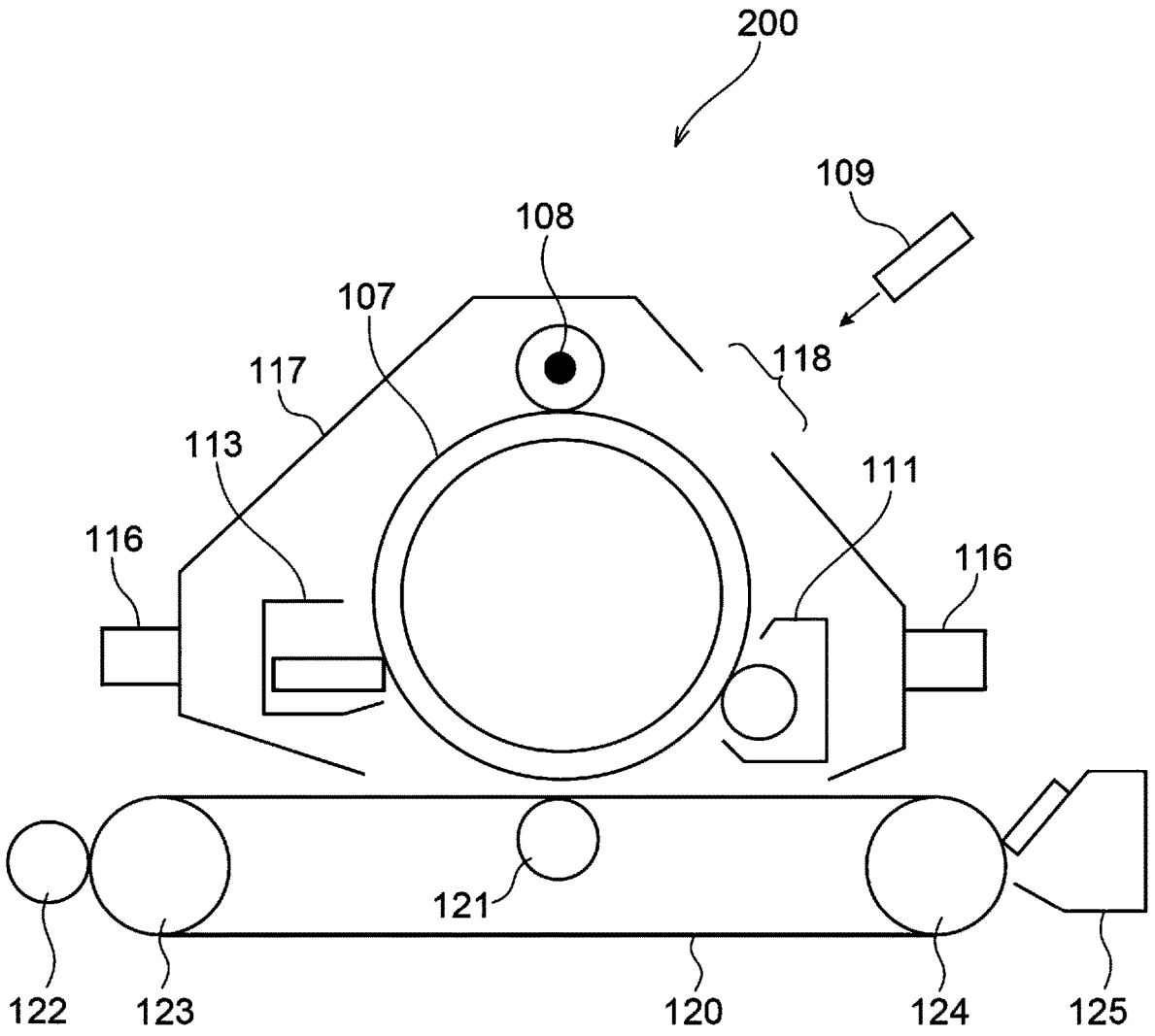
FIG. 2 schematically illustrates the structure of an example of a process cartridge according to an exemplary embodiment that is attached to and detached from an image forming apparatus.

FIG. 2 schematically illustrates the structure of an example of a process cartridge according to this exemplary embodiment that is attached to and detached from an image forming apparatus. The process cartridge 200 illustrated in FIG. 2 has a photoreceptor 107 (example of an image carrier) and its peripheral components held together in a housing 117 that has attachment rails 116 and an opening 118 for exposure to light. The peripheral components are a charging roller 108 (example of a charging component), a developing device 111 (example of a developing component), and a photoreceptor cleaning device 113 (example of a cleaning component for the image carrier). In addition to these, the process cartridge 200 has an intermediate transfer belt 120 (example of an intermediate transfer body), a first transfer roller 121 (example of a first transfer component), a second transfer roller 122 (example of a second transfer component), a support roller 123, a drive roller 124, and a cleaning device 125 for the intermediate transfer belt 120 (example of a cleaning component for the intermediate transfer body). The photoreceptor cleaning device 113 has a blade touching the photoreceptor 107. The cleaning device 125 for the intermediate transfer belt 120 has a blade touching the intermediate transfer belt 120. When the process cartridge 200 is set in an image forming apparatus and used for an image formation job, the photoreceptor 107 is exposed to light from an exposure device 109 (example of an electrostatic charge image creating component) that creates an electrostatic charge image on the surface of the photoreceptor 107.

The following describes a toner cartridge according to an exemplary embodiment.

The toner cartridge according to this embodiment contains a toner according to an above exemplary embodiment and is attached to and detached from an image forming apparatus. A toner cartridge is a cartridge that stores replenishment toner for a developing component of an image forming apparatus.

The image forming apparatus illustrated in FIG. 1 has been configured so that toner cartridges 8Y, 8M, 8C, and 8K are attached thereto and detached therefrom. The developing devices 4Y, 4M, 4C, and 4K are connected to their corresponding toner cartridges (or the toner cartridges for their respective colors) by toner feed tubing, not illustrated. When there is little toner in a toner cartridge, this toner cartridge is replaced.

EXAMPLES

The following describes exemplary embodiments of the present disclosure by providing examples, but the exemplary embodiments of the present disclosure are not limited to these Examples. In the following description, "parts" and "%" are by mass unless stated otherwise.

Production of Toners

Production of a Liquid Dispersion of an Amorphous Polyester Resin (A1)

Ethylene glycol: 37 parts
Neopentyl glycol: 65 parts
1,9-Nonanediol: 32 parts
Terephthalic acid: 96 parts These materials are loaded into a flask and heated to a temperature of 200° C. over 1 hour. After the reaction system has been stirred to uniformity, 1.2 parts of dibutyltin oxide is added. The temperature is increased to 240° C. over 6 hours while the water produced is removed by distillation, and stirring is continued for 4 hours at 240° C. This gives an amorphous polyester resin (acid value, 9.4 mg KOH/g; weight-average molecular weight, 13,000; glass transition temperature, 62° C.). The molten amorphous polyester resin is transferred to an emulsifying and dispersing machine (Cavitron CD1010, Eurotec) at a speed of 100 g per minute. Separately, reagent-grade aqueous ammonia is diluted with deionized water to a concentration of 0.37%. The resulting dilute aqueous ammonia is put into a tank and then, simultaneously with the amorphous polyester resin, transferred to the emulsifying and dispersing machine at a speed of 0.1 liters per minute while being heated to 120° C. in a heat exchanger. The emulsifying and dispersing machine is operated at a rotor speed of 60 Hz and a pressure of 5 kg/cm$^2$. This gives a 20%-solids liquid dispersion of an amorphous polyester resin (A1) in which the volume-average diameter of particles is 160 nm.

Production of a Liquid Dispersion of a Crystalline Polyester Resin (C1)

Decanedioic acid: 81 parts
Hexanediol: 47 parts

These materials are loaded into a flask and heated to a temperature of 160° C. over 1 hour. After the reaction system has been stirred to uniformity, 0.03 parts of dibutyltin oxide is added. The temperature is increased to 200° C. over 6 hours while the water produced is removed by distillation, and stirring is continued for 4 hours at 200° C. Then the reaction solution is cooled until solids separate out, and the solids are collected and dried at a temperature of 40° C. under reduced pressure. This gives a crystalline polyester resin (C1) (melting point, 64° C.; weight-average molecular weight, 15,000).

The crystalline polyester resin (C1): 50 parts
An anionic surfactant (Neogen RK, DKS Co., Ltd.): 2 parts
Deionized water: 200 parts These materials are heated to 120° C. and sufficiently dispersed using a homogenizer (ULTRA-TURRAX T50, IKA). The resulting dispersion is subjected to further dispersion using a pressure-pump homogenizer and collected when the volume-average particle diameter is 180 nm. The dispersion obtained is a 20%-solids liquid dispersion of a crystalline polyester resin (C1).

Production of a Liquid Dispersion of Release-Agent Particles (W1)

Paraffin wax (HNP-9, Nippon Seiro Co., Ltd.): 100 parts
An anionic surfactant (Neogen RK, DKS Co., Ltd.): 1 part
Deionized water: 350 parts These materials are mixed together and heated to 100° C., dispersed using a homogenizer (IKA ULTRA-TURRAX T50), and then further dispersed using a pressure-pump Gaulin homogenizer. This gives a liquid dispersion of release-agent particles having a volume-average diameter of 200 nm. The solids content is adjusted to 20% with deionized water to complete a liquid dispersion of release-agent particles (W1).

Production of a Liquid Dispersion of Coloring-Agent Particles (C1)

A cyan pigment (Pigment Blue 15:3, Dainichiseika Color & Chemicals Mfg.): 50 parts
An anionic surfactant (Neogen RK, DKS Co., Ltd.): 5 parts
Deionized water: 195 parts These materials are mixed together and dispersed for 60 minutes using a high-pressure impact dispersing machine (Ultimaizer HJP30006, Sugino Machine). This gives a 20%-solids liquid dispersion of coloring-agent particles (C1).

Production of Cyan Toner Particles (C1)

Deionized water: 200 parts

The liquid dispersion of an amorphous polyester resin (A1): 150 parts

The liquid dispersion of a crystalline polyester resin (C1): 10 parts

The liquid dispersion of release-agent particles (W1): 10 parts

The liquid dispersion of coloring-agent particles (C1): 15 parts

An anionic surfactant (TaycaPower): 2.8 parts

These materials are put into a stainless-steel round-bottom flask, the pH is adjusted to 3.5 with 0.1 N nitric acid, and then an aqueous solution of polyaluminum chloride prepared by dissolving 2 parts of polyaluminum chloride (Oji Paper Co., Ltd.; 30% powder) in 30 parts of deionized water is added. After dispersion at 30° C. using a homogenizer (IKA ULTRA-TURRAX T50), the mixture is heated to 45° C. in an oil bath for heating, and this state is maintained until the volume-average diameter of particles is 4.9 μm. Then 60 parts of the liquid dispersion of an amorphous polyester resin (A1) is added, and the mixture is allowed to stand for 30 minutes. When the volume-average diameter of particles is 5.2 μm, another 60 parts of the liquid dispersion of an amorphous polyester resin (A1) is added, and the mixture is allowed to stand for 30 minutes. Then 20 parts of a 10% aqueous solution of a metal salt of nitrilotriacetic acid (NTA) (CHELEST 70, Chelest Corporation) is added, and the pH is adjusted to 9.0 with a 1 N aqueous solution of sodium hydroxide. Then 1 part of the anionic surfactant (TaycaPower) is added, the mixture is heated to 85° C. with continued stirring, and this state is maintained for 5 hours. Then the mixture is cooled to 20° C. at a rate of 20° C./min, the cooled mixture is filtered, and the residue is washed thoroughly with deionized water and dried. This gives cyan toner particles (C1) having a volume-average diameter of 5.7 μm and an average roundness of 0.971.

Production of Layered-Compound Particles

Production of Melamine Cyanurate Particles

A commercially available melamine cyanurate (MC-4500, Nissan Chemical) is milled and classified using a jet mill into types of melamine cyanurate particles (1) to (6) with different average diameters.

Melamine cyanurate particles (1): number-average diameter of primary particles, 0.5 μm; monodisperse.

Melamine cyanurate particles (2): number-average diameter of primary particles, 0.2 μm; monodisperse.

Melamine cyanurate particles (3): number-average diameter of primary particles, 1.2 μm; monodisperse.

Melamine cyanurate particles (4): number-average diameter of primary particles, 5.0 μm; monodisperse.

Melamine cyanurate particles (5): number-average diameter of primary particles, 18.0 μm; monodisperse.

Melamine cyanurate particles (6): number-average diameter of primary particles, 65.0 μm; monodisperse.

Production of a Carrier

A mixture of 14 parts of toluene, 2 parts of a styrene-methyl methacrylate copolymer (ratio by mass at polymerization, 90:10; weight-average molecular weight, 80,000), and 0.2 parts of carbon black (Cabot R330) is stirred using a stirrer for 10 minutes to give a liquid dispersion. This liquid dispersion and 100 parts of ferrite particles (volume-average diameter, 36 μm) are stirred for 30 minutes at 60° C. in a vacuum-degassing kneader. The resulting mixture is dried by vacuuming and degassing the kneader while warming the mixture. Then fine and coarse powders are removed by elbow-jet classification. This gives a resin-coated carrier in which the volume-average diameter of particles is 36 μm.

Example 1

In a sample mill, 100 parts by mass of the cyan toner particles (C1), 2.00 parts by mass of a first type of hydrophobic silica particles (sol-gel silica particles hydrophobized with hexamethyldisilazane; number-average diameter, 50 nm), and 1.00 part by mass of a second type of hydrophobic silica particles (sol-gel silica particles hydrophobized with hexamethyldisilazane; number-average diameter, 120 nm) are mixed for 30 seconds at 10000 rpm. Then 0.100 parts by mass of melamine cyanurate particles (1) and 0.020 parts by mass of melamine cyanurate particles (5) are added to the sample mill, and the materials are mixed for 30 seconds at 10000 rpm. Screening the mixture using a vibrating sieve with a pore size of 45 μm gives toner. The toner and the carrier are put into a V-blender in a ratio of 5:100 (toner to carrier; by mass) and stirred for 20 hours to complete a developer.

Examples 2 to 12 and Comparative Examples 1 and 2

Toners and developers are obtained in the same way as in Example 1, except that the types and/or amounts of layered-compound particles and/or the number-average diameters or amounts of silica particles are changed in accordance with the specifications given in Table 1.

Performance Testing

Color Streaks Under Hot and Humid Conditions (Wearing of the Photoreceptor Cleaning Blade)

Using a modified Fuji Xerox 700 Digital Color Press, an image with an area coverage of 1.5% is printed on 100,000 sheets of A4 paper under the conditions of a temperature of 30° C. and a relative humidity of 85%. Then a chart as a combination of a solid image and a half-tone image (toner density, 0.1 mg/cm$^2$) is printed on a sheet of A4 paper. The half-tone image is visually inspected, and the contact portion of the photoreceptor cleaning blade is observed under a microscope (VH6200, Keyence) at a magnification of ×100. Performance is graded by the number of color streaks in the half-tone image and the condition of the contact portion of the photoreceptor cleaning blade as follows.

G1: No color streaks, and the photoreceptor cleaning blade is intact.

G2: No color streaks, but the photoreceptor cleaning blade is chipped.

G3: One to five color streaks, and the photoreceptor cleaning blade is chipped. Acceptable.

G4: Six or more color streaks, and the photoreceptor cleaning blade is chipped. Practically unacceptable.

Color Streaks Under Cold and Dry Conditions (Improper Cleaning of the Intermediate Transfer Belt)

Using a modified Fuji Xerox 700 Digital Color Press, an image with an area coverage of 25.0% is printed on 100,000 sheets of A4 paper under the conditions of a temperature of 10° C. and a relative humidity of 10%. Then a chart as a combination of a solid image and a half-tone image (toner density, 0.1 mg/cm$^2$) is printed on 500 sheets of A4 paper. The 10th, 50th, 100th, and 500th sheets are visually inspected, and performance is graded by the total number of color streaks in the half-tone image as follows.

G1: Zero

G2: One

G3: Two to five. Acceptable.

G4: Six or more. Practically unacceptable.

Transferability

Using a modified Fuji Xerox 700 Digital Color Press, a test chart with an area coverage of 35% is printed continuously on 20,000 sheets of A4 embossed paper (LEATHAC 66, Tokushu Tokai Paper Co., Ltd.) under the conditions of a temperature of 10° C. and a relative humidity of 15%. The fixing temperature and fixing pressure during image formation are set to 190° C. and 4.0 kg/cm$^2$, respectively. The image on the 20,000th sheet is observed using a ×100 measuring magnifier and graded as follows.

G1: The image has no sign of uneven transfer.

G2: The image has minor signs of uneven transfer, but they are acceptable in practical use.

G3: The image has signs of uneven transfer, but they are acceptable.

G4: The image has practically unacceptable signs of uneven transfer.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for developing an electrostatic charge image, the toner comprising:

TABLE 1

| | Layered-compound particles | | | | Silica particles | | | |
|---|---|---|---|---|---|---|---|---|
| | First type | Amount of the first type [parts] | Second type | Amount of the second type [parts] | Number-average diameter of a first type [nm] | Amount of the first type [parts] | Number-average diameter of a second type [nm] | Amount of the second type [parts] |
| Comparative Example 1 | (2) | 0.100 | (4) | 0.015 | 50 | 2.00 | 120 | 1.00 |
| Comparative Example 2 | (3) | 0.100 | (6) | 0.025 | 50 | 2.00 | 120 | 1.00 |
| Example 1 | (1) | 0.100 | (5) | 0.020 | 50 | 2.00 | 120 | 1.00 |
| Example 2 | (2) | 0.100 | (4) | 0.020 | 50 | 2.00 | 120 | 1.00 |
| Example 3 | (3) | 0.100 | (5) | 0.020 | 50 | 2.00 | 120 | 1.00 |
| Example 4 | (3) | 0.100 | (6) | 0.020 | 50 | 2.00 | 120 | 1.00 |
| Example 5 | (1) | 0.100 | (5) | 0.020 | 50 | 2.20 | 120 | 0.50 |
| Example 6 | (1) | 0.100 | (5) | 0.020 | 50 | 1.70 | 120 | 1.40 |
| Example 7 | (2) | 0.100 | (4) | 0.020 | 50 | 2.20 | 120 | 0.50 |
| Example 8 | (2) | 0.100 | (4) | 0.020 | 50 | 1.70 | 120 | 1.40 |
| Example 9 | (3) | 0.100 | (5) | 0.020 | 50 | 2.20 | 120 | 0.50 |
| Example 10 | (3) | 0.100 | (5) | 0.020 | 50 | 1.70 | 120 | 1.40 |
| Example 11 | (3) | 0.100 | (6) | 0.020 | 50 | 2.20 | 120 | 0.50 |
| Example 12 | (3) | 0.100 | (6) | 0.020 | 50 | 1.70 | 120 | 1.40 |

| | Toner | | | | | Color | Color | |
|---|---|---|---|---|---|---|---|---|
| | Number-average diameter of layered-compound particles | | | | | | | |
| | First peak [μm] | Second peak [μm] | Percentage Fa [% by volume] | Percentage Fb [% by volume] | Fa/Fb | streaks under hot and humid conditions (wearing of the photo-receptor cleaning blade) | streaks under cold and dry conditions (improper cleaning of the intermediate transfer belt) | Uneven transfer |
| Comparative Example 1 | 0.2 | 5.0 | 4.4 | 16.1 | 0.27 | G4 | G1 | G1 |
| Comparative Example 2 | 1.2 | 65.0 | 21.0 | 17.4 | 1.21 | G1 | G4 | G4 |
| Example 1 | 0.5 | 18.0 | 7.5 | 16.7 | 0.45 | G2 | G1 | G2 |
| Example 2 | 0.2 | 5.0 | 5.2 | 17.2 | 0.30 | G3 | G1 | G1 |
| Example 3 | 1.2 | 18.0 | 15.0 | 16.3 | 0.92 | G1 | G2 | G4 |
| Example 4 | 1.2 | 65.0 | 19.0 | 16.8 | 1.13 | G1 | G3 | G4 |
| Example 5 | 0.5 | 18.0 | 8.1 | 11.2 | 0.72 | G2 | G1 | G3 |
| Example 6 | 0.5 | 18.0 | 7.7 | 26.7 | 0.29 | G2 | G1 | G1 |
| Example 7 | 0.2 | 5.0 | 5.7 | 11.8 | 0.48 | G3 | G1 | G2 |
| Example 8 | 0.2 | 5.0 | 5.1 | 27.6 | 0.18 | G3 | G1 | G3 |
| Example 9 | 1.2 | 18.0 | 14.2 | 12.1 | 1.17 | G1 | G2 | G4 |
| Example 10 | 1.2 | 18.0 | 14.4 | 29.2 | 0.49 | G1 | G2 | G2 |
| Example 11 | 1.2 | 65.0 | 18.2 | 11.5 | 1.58 | G1 | G3 | G4 |
| Example 12 | 1.2 | 65.0 | 18.7 | 28.1 | 0.67 | G1 | G3 | G3 |

toner particles, layered-compound particles, and inorganic particles, a percentage Fa of layered-compound particles free from the toner particles being 5% by volume or more and 20% by volume or less.

2. The toner according to claim 1 for developing an electrostatic charge image, wherein the percentage Fa of layered-compound particles free from the toner particles is 5% by volume or more and 10% by volume or less.

3. The toner according to claim 1 for developing an electrostatic charge image, wherein the percentage Fb of inorganic particles free from the toner particles is 10% by volume or more and 30% by volume or less.

4. The toner according to claim 3 for developing an electrostatic charge image, wherein the percentage Fb is 10% by volume or more and 20% by volume or less.

5. The toner according to claim 3 for developing an electrostatic charge image, wherein a ratio Fa/Fb between the percentage Fa and the percentage Fb is 0.20 or more and 0.50 or less.

6. The toner according to claim 5 for developing an electrostatic charge image, wherein the ratio Fa/Fb between the percentage Fa and the percentage Fb is 0.20 or more and 0.35 or less.

7. The toner according to claim 1 for developing an electrostatic charge image, wherein the layered-compound particle content is 0.02% by mass or more and 0.50% by mass or less of the toner for developing an electrostatic charge image as a whole.

8. The toner according to claim 1 for developing an electrostatic charge image, wherein the inorganic particle content is 1.0% by mass or more and 7.0% by mass or less of the toner for developing an electrostatic charge image as a whole.

9. The toner according to claim 1 for developing an electrostatic charge image, wherein the layered-compound particles include at least one selected from the group consisting of melamine cyanurate particles, boron nitride particles, fluorinated graphite particles, molybdenum disulfide particles, and mica particles.

10. The toner according to claim 1 for developing an electrostatic charge image, wherein the inorganic particles include silica particles.

11. An electrostatic charge image developer comprising the toner according to claim 1 for developing an electrostatic charge image.

12. A process cartridge that is attached to and detached from an image forming apparatus, the process cartridge comprising:

an image carrier;

a developing component that contains the electrostatic charge image developer according to claim 11 and develops, using the electrostatic charge image developer, an electrostatic charge image created on a surface of the image carrier to form a toner image;

an intermediate transfer body to which the toner image is transferred from the surface of the image carrier;

a cleaning component for the image carrier that has a blade touching the surface of the image carrier and cleans, using the blade, residual toner off the surface of the image carrier from which the toner image has been transferred; and a cleaning component for the intermediate transfer body that has a blade touching a surface of the intermediate transfer body and cleans, using the blade, residual toner off the surface of the intermediate transfer body from which the toner image has been transferred to the surface of a recording medium.

13. An image forming apparatus comprising:

an image carrier;

a charging component that charges a surface of the image carrier;

an electrostatic charge image creating component that creates an electrostatic charge image on the charged surface of the image carrier;

a developing component that contains the electrostatic charge image developer according to claim 11 and develops, using the electrostatic charge image developer, the electrostatic charge image created on the surface of the image carrier to form a toner image;

an intermediate transfer body to which the toner image is transferred from the surface of the image carrier;

a first transfer component that transfers the toner image on the surface of the image carrier to the surface of the intermediate transfer body;

a second transfer component that transfers the toner image on the surface of the intermediate transfer body to a recording medium;

a fixing component that fixes the toner image on a surface of the recording medium;

a cleaning component for the image carrier that has a blade touching the surface of the image carrier and cleans, using the blade, residual toner off the surface of the image carrier from which the toner image has been transferred; and a cleaning component for the intermediate transfer body that has a blade touching the surface of the intermediate transfer body and cleans, using the blade, residual toner off the surface of the intermediate transfer body from which the toner image has been transferred to the surface of the recording medium.

14. An image forming method comprising:

charging a surface of an image carrier;

creating an electrostatic charge image on the charged surface of the image carrier;

developing, using the electrostatic charge image developer according to claim 11, the electrostatic charge image created on the surface of the image carrier to form a toner image;

transferring the toner image on the surface of the image carrier to a surface of an intermediate transfer body;

transferring the toner image on the surface of the intermediate transfer body to a surface of a recording medium;

fixing the toner image on the surface of the recording medium;

cleaning, by putting a blade on the surface of the image carrier, residual toner off the surface of the image carrier from which the toner image has been transferred; and cleaning, by putting a blade on the surface of the intermediate transfer body, residual toner off the surface of the intermediate transfer body from which the toner image has been transferred to the surface of the recording medium.

15. A toner cartridge that is attached to and detached from an image forming apparatus, the toner cartridge comprising the toner according to claim 1 for developing an electrostatic charge image.

* * * * *